US005356277A

United States Patent [19]

Yamaguchi et al.

[11] Patent Number: 5,356,277

[45] Date of Patent: Oct. 18, 1994

[54] VANE TYPE GAS COMPRESSOR

[75] Inventors: Masaru Yamaguchi; Makoto Ijiri; Shuji Yamane, all of Narashino; Yutaka Shimizu, Sano, all of Japan

[73] Assignees: Seiko Seiki Kabushiki Kaisha; Calsonic Corp., Japan

[21] Appl. No.: 17,324

[22] Filed: Feb. 11, 1993

[30] Foreign Application Priority Data

Feb. 12, 1992 [JP] Japan ..... 4-005246[U]

[51] Int. Cl.[5] ..... F01C 21/02

[52] U.S. Cl. ..... 418/179; 418/178; 384/913; 384/276

[58] Field of Search ..... 418/178, 179, 268; 417/902; 384/913, 276

[56] References Cited

U.S. PATENT DOCUMENTS

| | | | |
|---|---|---|---|
| 3,935,797 | 2/1976 | Niimi et al. | 384/913 |
| 4,804,317 | 2/1989 | Smart et al. | 418/178 |
| 4,867,658 | 9/1989 | Sugita et al. | 418/268 |
| 4,944,663 | 7/1990 | Iizuka et al. | 418/168 |
| 5,055,016 | 10/1991 | Kawade | 418/179 |
| 5,073,213 | 12/1991 | Pfestorf | 148/262 |

FOREIGN PATENT DOCUMENTS 0059273 9/1982 European Pat. Off. .
0399425 11/1990 European Pat. Off. .
0438922 7/1991 European Pat. Off. .

OTHER PUBLICATIONS

Patent Abstracts of Japan, vol. 9, No. 29 (M-356) (1752) Feb. 7, 1985.

*Primary Examiner*—Richard A. Bertsch
*Assistant Examiner*—Charles G. Freay
*Attorney, Agent, or Firm*—Bruce L. Adams; Van C. Wilks

[57] ABSTRACT

A rotary vane compressor comprises a cylinder having two closed ends defining a cylinder chamber in which is rotatably mounted a rotor. The rotor carries a plurality of radially movable vanes which move radially into sliding contact with the inner surface of the cylinder chamber during rotation of the rotor to compress a refrigerant gas. The rotor is rotationally driven by a rotor shaft rotatably mounted by bearings in the cylinder ends. To prevent destruction of the ozone layer, a refrigerant containing no chlorine, such as HFC-134*a* (1,1,1,2-tetrafluoroethane; $CH_2FCF_3$) is used, and to compensate for the inferior lubricating properties of the chlorine-free refrigerant, the bearings are provided with a manganese phosphate coating of 10 μm–15 μm thickness to prevent cohesion and seizure of the mutually contacting surfaces of the bearings and rotor shaft.

12 Claims, 2 Drawing Sheets

VANE TYPE GAS COMPRESSOR

BACKGROUND OF THE INVENTION

The present invention relates generally to a vane type gas compressor, and in particular to a vane type gas compressor used for air conditioners for automobiles.

As conventional vane type gas compressors, for example, there are those in which a front side block, a rear side block, a cylinder, a rotor and vanes which constitute the compressor main body are made of aluminum alloys, a rotor shaft is made of a hardened steel material such as an SCM material or the like, and CFC-12 (dichlorodifluoromethane; $CCl_2F_2$) is used as a refrigerant.

In such a vane type gas compressor, the rotor shaft is maintained in a plain bearing, wherein both ends of the rotor shaft are supported in a manner freely capable of rotation by means of bearing portions provided at boss portions at the centers of the front side block and the rear side block, respectively. The lubrication at the bearing portions has been usually performed by blowing lubricating oil under a high pressure from an oil reservoir in the rear space of a casing, or by using lubricating oil dissolved in CFC-12 refrigerant. In addition, lubrication has been also performed by the lubricating action of the CFC-12 itself.

However, CFC-12, which is used for the conventional vane type gas compressor, contains chlorine as a component, and this chlorine destroys the ozone layer, so that the use of CFC-12 as a refrigerant for automobile air conditioners will be prohibited in the future.

Therefore, an alternative refrigerant is necessary, and for this purpose, it is considered that a refrigerant containing no chlorine is used. However, the chlorine itself is an element having good lubricating action, so that on the contrary, when a refrigerant containing no chlorine is used, its lubricating property is inferior to that of CFC-12.

For example, when the compressor is stopped under an operating condition in which a relatively small amount of lubricating oil is in the oil reservoir in the rear space of the casing, and this condition is left for a long time, such a state occurs that the lubricating oil is diluted by the liquid refrigerant, and the lubricating oil at the bearing portion is washed out by the liquid refrigerant. When the compressor is started from this state, the bearing portion temporarily is in a no-oil feeding state, however, when the refrigerant containing no chlorine is used, the lubricating action of the refrigerant itself cannot be expected at all, so that there is a fear to cause a new problem that cohesion takes place due to the mutual sliding contact between metals of the rotor shaft of the iron series metal and the bearing surface of the aluminum alloy, resulting in seizure.

SUMMARY OF THE INVENTION

Thus the present invention has been made taking the above-mentioned problem into consideration, and an object of the present invention is to provide a vane type gas compressor wherein a refrigerant which does not destroy the ozone layer is used, and no cohesion takes place at the bearing portions of both side blocks.

In order to carry out the present invention, a vane type gas compressor is provided with a cylinder which has an inner circumference of a substantially oval cylinder shape, front and rear side blocks attached to both sides of the cylinder, a rotor accommodated in a cylinder chamber formed by the side blocks and said cylinder in a manner freely capable of rotation, a rotor shaft which transmits rotational force to the rotor, and a plurality of vanes inserted into a plurality of vane grooves provided in the radial direction of the rotor in a manner freely capable of frontward and rearward movement, wherein said front and rear side blocks are each provided with plain bearings for supporting the rotor shaft in a manner freely capable of rotation, while said cylinder, front side block, rear side block, rotor and vanes are made of aluminum alloys, and the rotor shaft is made of an iron series metal, and wherein a refrigerant HFC-134*a* (1,1,1,2-tetrafluoroethane; $CH_2FCF_3$) is used as the gas, and said plain bearings are such that bushes, which are made of cast iron and have bearing surfaces to which a phosphate coating treatment is applied, are fitted and fastened by insertion under pressure or the like into holes opened at boss portions of the front and the rear side blocks.

In accordance with the above-mentioned constitution, HFC-134*a* which contains no chlorine is used as the refrigerant, so that the destruction of the ozone layer is prevented.

In addition, each of the bearing portions of the front and the rear side blocks are subjected to insertion under pressure of the bushes (bearing metals) which are made of cast iron and which have their bearing surfaces applied with a phosphate coating treatment, so that even when lubricating oil is not supplied temporarily to the spaces between the bushes and the rotor shaft thereby causing no-lubrication state, no cohesion or seizure results.

DETAILED DESCRIPTION OF THE PREFERRED EMBODIMENTS

Figure 1:
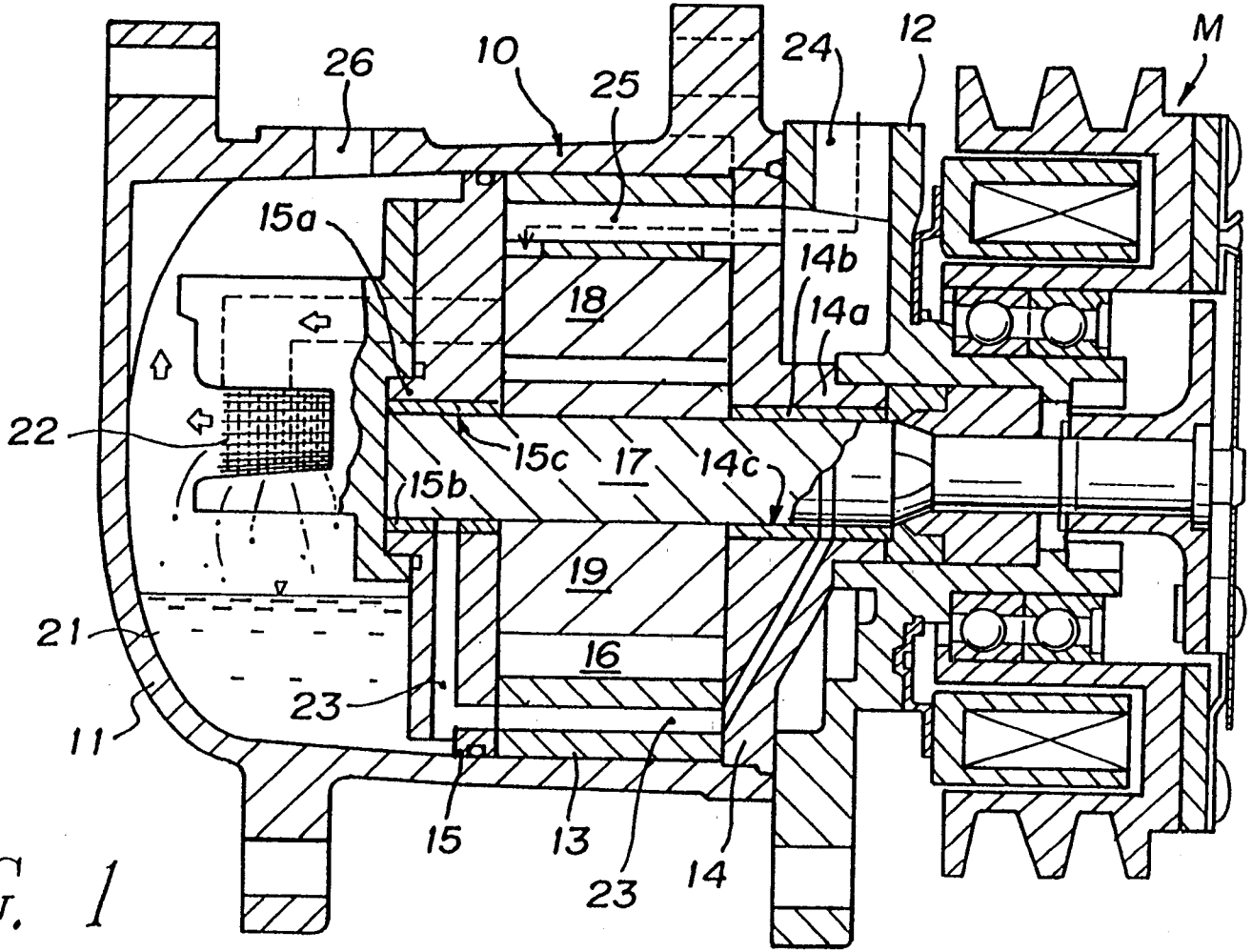
FIG. 1 is a cross-sectional view showing the whole constitution of a vane type gas compressor according to the present invention.

An example of rotary vane type gas compressor according to the present invention will be explained hereinafter on the basis of the drawings. FIG. 1 is a cross-sectional view showing the whole constitution of the vane type gas compressor according to the present invention, and FIG. 2 is a cross-sectional view showing a bearing portion of the vane type compressor.

As shown in FIG. 1, this vane type gas compressor is constituted by an electromagnetic clutch M, a compressor main body 10, a casing 11 of a shape having an opening at one end for surrounding the compressor main body 10 in an air-tight manner, and a front head 12 attached to the opening end face of the casing 11.

The compressor main body 10 has a cylinder 13 having an inner circumference of a substantially oval cylinder shape, and a front end or side block 14 and a rear end or side block 15 which are attached to opposite sides of the cylinder 13, thereby defining a cylinder chamber 16 having a substantially oval cylinder shape. In the cylinder chamber 16 is accommodated a rotor 19 which is integrated with a rotor shaft 17 and installed with a plurality of vanes 18 at the circumference in a manner freely capable of frontward and rearward movement within a plurality of vane grooves provided in the radial direction thereof.

Figure 2:
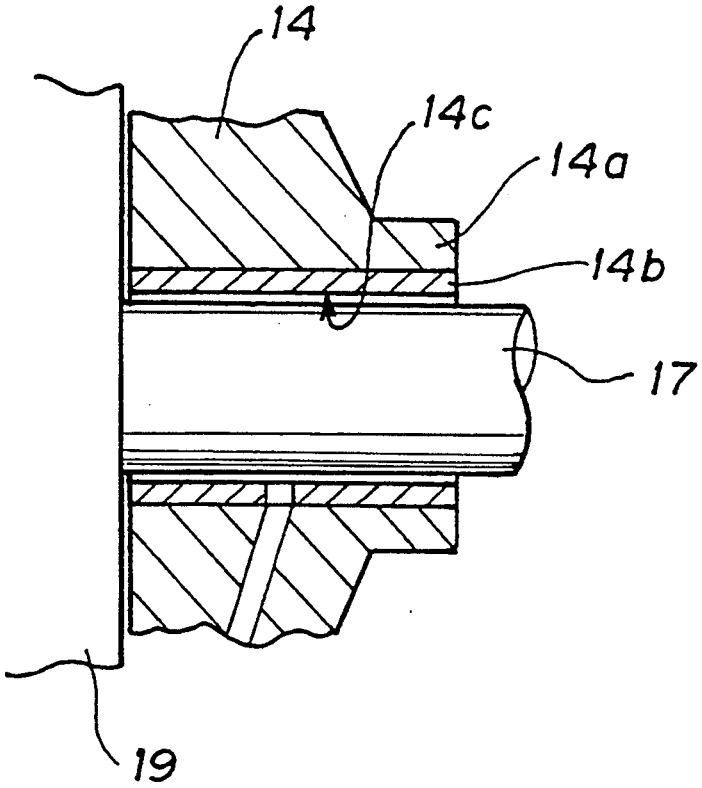
FIG. 2 is a cross-sectional view showing a bearing portion of the vane type compressor.

At the center of the front side block 14, a boss portion 14*a* is formed as shown in FIG. 2. In addition, at the rear side block 15, a boss portion 15*a* is formed in the same manner as the front side block 14.

Further, the compressor main body 10, the rotor 19 and the vanes 18 are formed, for example, from aluminum alloys such as hyper-eutectic Al-Si alloy casting materials or the like, while the rotor shaft 17 is formed from a hardened steel material such as SCM, SCr or the like.

In the present example, as the refrigerant gas, HFC-134*a* (1,1,1,2-tetrafluoroethane; $CH_2FCF_3$) containing no chlorine is used.

Further, in the present example, bushes or bushings 14*b* and 15*b*, which are made of cast iron and have at least their bearing surfaces subjected to a phosphate coating treatment, are fitted and fastened into the boss portions 14*a* and 15*a* by means of a method of insertion under pressure or the like, and both end portions of the rotor shaft 17 are inserted into the bushes 14*b* and 15*b* so as to support the rotor 19 in a manner freely capable of rotation.

The bushes 14*b* and 15*b* are cast iron corresponding to FC 25, which are cast into a column shape or a cylinder shape and then finished into a predetermined size and accuracy for the outer diameter, inner diameter and length by means of mechanical processing. When the bushes are introduced into a chemical conversion treatment tank for iron, and by means of known treatment steps, a chemical conversion treatment coating of phosphate is formed on the entire surfaces of the bushes, or at least on the bearing surfaces thereof. As the phosphate coating, a manganese phosphate coating is most preferable. This coating is extremely hard as compared with coatings usually used for plastic working such as zinc phosphate, calcium zinc phosphate and the like, so that it is excellent in abrasion resistance.

In FIG. 1, 21 is an oil reservoir for storing lubricating oil, 22 is an oil separator for separating lubricating oil from the refrigerant gas, 23 is an oil communication passage for supplying lubricating oil to bearing surfaces 14*c* and 15*c* of the side blocks 14 and 15, 24 is a suction port for sucking the refrigerant gas, 25 is a suction passage and 26 is a discharge port from which the refrigerant gas is discharged.

Next, the operation of the vane type gas compressor thus constituted will be explained, wherein it is assumed that the rotor shaft 17 rotates on the bearing surfaces 14*c* and 15*c* of the side blocks 14 and 15 in the no-lubrication state in which there is no lubricating oil on the mutually contacting surfaces of the rotor shaft 17 and the bearing surfaces 14*c* and 15*c*.

In this case, in the present example, HFC-134*a* containing no chlorine component is used as the refrigerant, so that the lubricating property of the refrigerant is inferior as compared with the case in which CFC-12 is used.

However, when the bearing surfaces 14*c* and 15*c* of the side blocks 14 and 15 are formed in accordance with the present invention as apposed to the conventional bearing surface made of a soft aluminum alloy, owing to such reasons that the base substrate of the bearings becomes hard, the surface of the iron base substrate is coated with the above-mentioned manganese phosphate coating and the like, the cohesion with rotor shaft 17 made of steel material is prevented.

The thickness of the phosphate coating can be made fairly thick to be about 10 to 15 μm including a thickness of an etching layer, so that even after severe operation or after use for a long period, there is no likelihood that the iron base substrate is exposed as a result of complete abrasion, and there is no likelihood that the iron base substrate and the iron of the rotor shaft are subjected to direct sliding contact to cause cohesion, further resulting in seizure.

As an alternative measure, it is also possible to directly apply the chemical conversion treatment onto the aluminum alloy, however, a chemical conversion treatment coating on the aluminum alloy is different from the coating on the iron steel material, which cannot have a thick coating thickness (usually about 1 to 2 μm), and is soft and weak in adhesion, so that it is easily peeled off due to the sliding contact with the rotor shaft, whereupon the base substrate of the aluminum alloy is exposed and the effect of preventing seizure cannot be obtained.

Therefore, in the present example, HFC-134*a* containing no chlorine component is used as the refrigerant, and the lubricating property thereof is inferior as compared with the case in which the conventional CFC-12 is used. However, the inferior lubricating property of the HFC-134*A* is compensated for by provision of the phosphate-coated bushes 14*b* and 15*b* so that even when the rotor shaft 17 rotates on the bearing portions of the side blocks 14 and 15 in the no-lubrication state in which there is no lubricating oil, the bearing portions are provided with the above-mentioned bushes 14*b* and 15*b* which are excellent in abrasion resistance and seizure resistance, so that no cohesion takes place resulting in seizure. In addition, HFC-134*a* is different from CFC-12 and contains no chlorine component, so that the ozone layer is not destroyed by chlorine, and environmental destruction can be prevented.

Incidentally, the cast iron (FC material) has been used as the bush material in the present example, however, it is also possible that a sintered material of the iron series is used, and the phosphate coating treatment is applied in the same manner.

In addition, the bushes 14*b* and 15*b* have been fitted and fastened by insertion under pressure into the boss portions 14*a* and 15*b*, however, for example, it is also possible to contemplate the integration of an aluminum alloy cast article or a die-cast article with the bush by means of an internal chill method and the like.

As explained above, according to the present invention, with respect to the vane type gas compressor in which the cylinder block, the front side block, the rear side block, the rotor and the vanes are made of aluminum alloys, and the rotor shaft which is supported between the bearing portions of both side blocks in a manner freely capable of rotation, HFC-134*a* (1,1,1,2-tetrafluoroethane) containing no chlorine is used as the refrigerant, and each of the bearing portions of the front side block and the rear side block is provided with a bush which is made of cast iron and subjected to a phosphate coating treatment, so that no chlorine is generated and the destruction of the ozone layer is prevented, and cohesion at the bearing surface can be prevented even in the case of the no-lubrication state in which there is no lubricating oil at the bearing portion.

What is claimed is:

1. A vane type gas compressor comprising:

a cylinder having an inner circumference of a substantially oval shape;

a front and a rear side blocks attached to both sides of the cylinder for forming a cylinder chamber;

a rotor rotatably provided in the cylinder chamber;

a rotor shaft for transmitting rotational force to the rotor;

a plurality of vanes inserted into a plurality of vane grooves provided in the radial direction of the rotor in a manner freely slidable in the grooves;

a plurality of plain bearings provided respectively in the front and the rear side blocks for rotatably supporting the rotor shaft; and a refrigerant HFC-134*a* (1,1,1,2-tetrafluoroethane; $CH_2FCF_3$) comprising the compressible gas of the gas compressor;

wherein the cylinder, the front and the rear side blocks, the rotor and the vanes are made of aluminum alloys, and the rotor shaft is made of an iron series metal; and wherein the plain bearings are made of cast iron and have bearing surfaces to which a manganese phosphate coating treatment is applied.

2. A vane type gas compressor according to claim 1, wherein the plain bearings are fitted and fastened respectively by insertion under pressure into holes opened at boss portions of the front and the rear side blocks.

3. A vane type gas compressor according to claim 1, wherein the thickness of the manganese phosphate coating is in a range from 10 μm to 15 μm.

4. A rotary vane compressor, comprising: a hollow cylinder having two closed ends defining a cylinder chamber; a rotor rotatably disposed in the cylinder chamber and having at least one radial slot; a vane slidably disposed in each radial slot so that rotation of the rotor causes the vane to make sliding engagement with an inner surface of the cylinder chamber; a rotor shaft made of an iron series metal extending through openings in the ends of the cylinder and connected to rotationally drive the rotor; and bearing means for rotatably mounting the rotor shaft in the openings in the ends of the cylinder, the bearing means comprising cast iron bushings inserted in respective ones of the openings in the cylinder ends, the bushings having bearing surfaces coated with a manganese phosphate coating effective to lubricate mutually contacting surfaces of the rotor shaft and bushings to prevent cohesion and seizure between said contacting surfaces when the compressor is operated using a refrigerant having poor lubricating properties.

5. A rotary vane compressor according to claim 4; wherein the cylinder ends are made of aluminum alloy.

6. A rotary vane compressor according to claim 4; wherein the manganese phosphate coating has a thickness in the range from 10 μm to 15 μm.

7. A rotary vane compressor according to claim 4; wherein the cylinder, cylinder ends, rotor and vane are made of aluminum alloys.

8. A rotary vane compressor according to claim 4; wherein the manganese phosphate coating is effective to prevent cohesion and seizure between the mutually contacting surfaces of the rotor shaft and bushings when the compressor is operated using HFC-134*a* (1,1,1,2-tetrafluoroethane; $CH_2FCF_3$) as the refrigerant.

9. A rotary vane compressor according to claim 4; wherein the manganese phosphate coating has a thickness of at least 10 μm.

10. A rotary machine comprising; a rotationally driven rotor shaft made of an iron series metal; a rotor connected to be rotationally driven by the rotor shaft; and means for rotatably mounting the rotor shaft, said means comprising a pair of spaced-apart support members made of aluminum alloy and each having an opening therein, and a cast iron bushing inserted in each opening and through which the rotor shaft extends, each bushing having a manganese phosphate-coated bearing surface effective to lubricate mutually contacting surfaces of the rotor shaft and bushing to prevent cohesion and seizure between said contacting surfaces during rotation of the rotor shaft.

11. A rotary machine according to claim 10; wherein the manganese phosphate coating has a thickness of at least 10 μm.

12. A rotary machine according to claim 11; wherein the manganese phosphate coating has a thickness in the range from 10 μm to 15 μm.

* * * * *